United States Patent [19]

Schulte et al.

[11] Patent Number: 4,480,413

[45] Date of Patent: Nov. 6, 1984

[54] BLADED CENTRIFUGAL BLASTING WHEEL

[75] Inventors: Harold F. Schulte, Mishawaka; Raymond M. Leliaert; Robert D. Rohr, both of South Bend, all of Ind.

[73] Assignee: Wheelabrator-Frye Inc., Hampton, N.H.

[21] Appl. No.: 368,420

[22] Filed: Apr. 14, 1982

Related U.S. Application Data

[60] Continuation-in-part of Ser. No. 316,749, Oct. 30, 1981, abandoned, which is a division of Ser. No. 78,478, Sep. 24, 1979, Pat. No. 4,333,278.

[51] Int. Cl.[3] ..... B24C 5/06

[52] U.S. Cl. ..... 51/435

[58] Field of Search ..... 51/432, 434, 435; 241/275; 416/214 A, 214 R

[56] References Cited

U.S. PATENT DOCUMENTS

| | | | |
|---|---|---|---|
| 1,052,291 | 2/1913 | Smoot . | |
| 2,077,638 | 4/1937 | Minich . | |
| 2,212,451 | 8/1940 | Peik . | |
| 2,732,666 | 1/1956 | Powell . | |
| 2,819,562 | 1/1958 | Barnes | 51/435 |
| 2,869,289 | 1/1959 | Gossard . | |
| 3,197,920 | 8/1965 | Moore et al. | 51/435 |
| 3,444,651 | 5/1969 | Geisseler | 51/434 |
| 3,683,556 | 8/1972 | Leliaert . | |
| 3,745,711 | 7/1973 | Haberlin . | |
| 3,785,105 | 1/1974 | Freeman . | |
| 4,069,025 | 1/1978 | MacMillan | 51/434 |
| 4,176,502 | 12/1979 | Leliaert . | |
| 4,203,263 | 5/1980 | Fiala . | |
| 4,207,712 | 6/1980 | Toedtli . | |

*Primary Examiner*—Frederick R. Schmidt
*Assistant Examiner*—Robert A. Rose
*Attorney, Agent, or Firm*—McDougall, Hersh & Scott

[57] ABSTRACT

A centrifugal blasting wheel includes a pair of front and back wheel plates interconnected in spaced parallel relationship. Each wheel plate has a central opening defined by an annular surface of constant diameter. These plates are provided with respective cross-wise aligned grooves in their inner faces extending radially in equally circumferentially spaced relationship from the inner annular surfaces of the plates to the outer annular surfaces thereof and opening into each of the annular surfaces. A blade is removably mounted between each pair of aligned grooves. Each blade has a body generally in the form of a parallelepiped with an inner and an outer end and side flanges to define a blade of I-shape in transverse cross-section. Each blade has at least one retaining lug extending laterally from one of the side flanges and being substantially closer to the inner end of the blade body than the outer end thereof. Each such lug is provided with a curved, non-planar, smooth and uninterrupted abutment surface arranged to be in substantial co-extensive engagement with a portion of the inner annular surface of the adjacent wheel plate when the blade is operatively positioned between a pair of the grooves. This mounting arrangement minimizes development of stress concentrations between the lug and the adjacent wheel plate. The abutment surfaces are configured so that radial forces only are transferred from the lug to the adjacent wheel plate.

6 Claims, 20 Drawing Figures

BLADED CENTRIFUGAL BLASTING WHEEL

This application is a continuation-in-part of application, Ser. No. 316,749 now abandoned, filed Oct. 30, 1981, which in turn is a division of application, Ser. No. 78,478, filed Sept. 24, 1979, now U.S. Pat. No. 4,333,278.

This invention relates to bladed wheels whereby particulate material is thrown with centrifugal force from the ends of the blades onto an object or surface to be abraded, cleaned, or otherwise engaged by the particulate material for surface treatment.

Airless centrifugal throwing wheels of the type described are marketed by Wheelabrator-Frye Inc. under the trademark WHEELABRATOR. Such wheels consist of a pair of spaced parallel side plates having a number of blades extending radially between the plates in equally circumferentially spaced apart relation, with means removably securing the blades between the plates. Means are provided for rotating the bladed wheel at high speed about a central axis and for depositing particulate material onto the inner end portions of the blades whereby the particulate material is displaced by centrifugal force outwardly over the surface of the blades and projected at high velocity from the ends of the blades. Means, such as an impeller, is provided in the central opening for feeding the particulate material onto the inner ends of the blades, with a stationary control cage surrounding the impeller for controlling the passage of particulate material to the blades thereby controlling the direction as well as the blast pattern of the particulate material thrown from the ends of the blades.

It is an object of this invention to provide a bladed wheel of the type described which embodies numerous improvements in the construction and in the assembly of such wheel and in parts of which it is formed, including improvements in the blades per se, which enables the wheel to be rotated at high speed in either direction for universal operation as a right hand or left hand wheel; which embodies means for center insertion and removal of the blades with improved locking of the blades in position of use between the plates; which includes means for insertion of the blades through the central opening between the plates; which embodies means for interrelating the impeller with the blades for precise timing therebetween; which embodies means for positioning the control cage and for maintaining the setting of the control cage for control of the blast pattern; which embodies means for keeping the hub seal area free of particulate material thereby to enhance the sealed relation and the useful life of the seal; and which makes use of a control cage with a ring seal that is effective to decrease wear on the inner ends of the blades resulting from abrasion of particulate material and dust induced through the gap between the cage and the front wheel plates.

These and other objectives and advantages of this invention will hereinafter appear and for purposes of illustration, but not of limitation, an embodiment of the invention is shown in the attached drawings in which.

Figure 1:
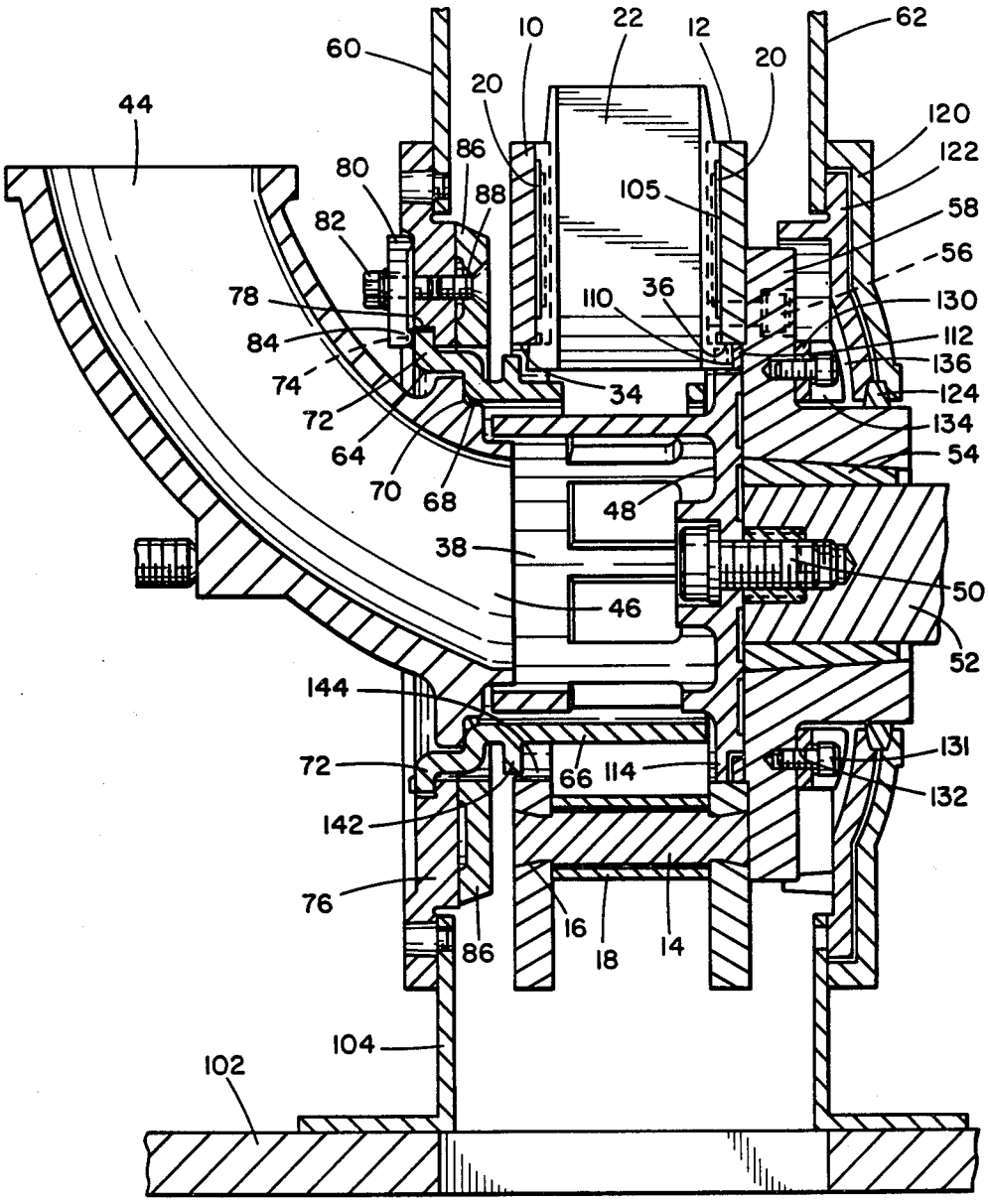
FIG. 1 is a sectional elevational view of the bladed wheel embodying the features of this invention.

Referring now to the drawings; the wheel is formed of a pair of disc plates hereinafter referred to as a front plate 10 and a back plate 12 secured one to the other in spaced apart relation by circumferentially spaced apart spacers 14 which extend through laterally aligned openings 16 in the front and back plates 10 and 12. The portion of each spacer extending between the plates is protected by a sleeve 18 formed of hard, wear-resistant material and dimensioned to have a length corresponding to the spaced relation between the plates 10 and 12 and having an inner diameter which is slightly greater than the outer diameter of the spacer 14 and an outer diameter greater than the diameter of the opening 16 so as to extend in the area between the front and back plates immediately surrounding the openings 16.

The front and back plates 10 and 12 are formed with crosswise aligned pairs of radially extending slots 20 spaced circumferentially along the inner walls of the plates for the recepts of blades 22, each of which is formed with two faces 24 and 26, dimensioned to have a width approximately equal to the distance between the plates and integral lateral edge portions 28 and 30 which extend above and below the faces and are dimensioned slidably to be received in the aligned slots 20 for supporting the blades in mounted relation between the wheel plates 10 and 12. The two faces 24 and 26 of the blades are flat with the inner end portions being formed of diminishing cross section to provide a slight curvature 32 from the inner end outwardly for receipt of particulate material with a minimum of abrasive wear.

The front and back plates 10 and 12 are formed with central openings 34 and 36 to define a circular section in which a vaned impeller 38 of cylindrical shape is received for rotational movement with the wheel plates. The vaned impeller 38 has an outside diameter dimensioned to be less than the diameter of the central opening in the front plate to define an annular space therebetween for receipt of a fixed control cage 40 of cylindrical shape having one or more lengthwise extending slots 42 through which material is fed by the impeller 38 onto the inner ends 32 of the blades 22 during rotational movement.

A feed spout 44 is mounted at an upward incline with the outlet opening 46 at the lower end in endwise alignment with the central opening of the cylindrical impeller and in slight telescoping relation therewith for feeding particulate material into the interior of the impeller. The impeller is formed with a back face 48 which is connected by means of a lock bolt 50 onto a shaft 52 supported by bearings for rotational movement, as by suitable driving means (not shown) such as a belt, gear or other indirect drive or directly driven by an electrical motor or the like. The back wheel plate 12 is in turn bolted (56) onto a hub 58 connected with a tapered lock bushing 54 with the shaft 52 for rotational movement therewith.

The wheel is protected by a guard housing having fixed front and back guard plates 60 and 62 in spaced parallel relation with the wheel plates to project beyond the outer ends therewith.

In operation, the impeller 38 and the bladed wheel plates 10 and 12 are rotated at high speed in one direction about the central axis. Particulate material is fed from the feed spout 44 into the interior of the impeller 38 from which it is dispensed radially through slot in the stationary control cage 40 onto the inner ends of the blades 22. Responsive to the centrifugal forces operating on the particulate material during rapid rotational movement of the wheel, the particulate material is displaced outwardly over the face of the blades, with increasing velocity, until thrown at high speed, from the ends of the blades. Because of the construction of the blades with substantially identical front and back faces, the direction of rotation of the wheel can be reversed whereby the opposite face becomes the face over which the particulate material travels during the blast cycle thereby to eliminate the need for separate right hand and left hand wheels.

By selectively positioning the slot 42 of the control cage 40 through which the particulate material is projected by the impeller 38, it is possible narrowly to define the sector from which the particulate material is thrown centrifugally from the ends of the blades thereby to concentrate the particulate material while controlling the blast pattern and the direction at which the particulate material is thrown centrifugally from the ends of the blades.

For this purpose, the control cage is mounted for rotation relative to the impeller 38 and the wheel plates 10 and 12 to the desired position of adjustment, and means are provided for releasably clamping the control cage to maintain the control cage in the adjusted position. As illustrated in the drawings, the control cage is formed with an annular flanged portion 64 extending outwardly from the forward edge of the cylindrical section 66 including an annular inner elbow portion 68 with rides on an adjacent portion of the feed spout 44 with a ring seal 70 in between, and an annular outwardly extending rim portion 72 formed with serrations 74 or rack teeth on the outer face. The control cage is supported for rotational movement to an adjustable fixed position by a control cage adapter plate 76 having an annular slot 78 in its inner face dimensioned to receive the annular rim end portion 72 of the control cage.

The control cage 40 is locked in its adjusted position by one or more clamping means including clamp 80 adapted releasably to be secured to the adapter plate 76, as by means of a nut and bolt arrangement 82 which extends through aligned openings in the clamp 80 and adapter 76, with one or more projections 84 extending outwardly from an end portion of the clamping member 80 in endwise alignment with the serrated edge 74 of the control cage for engagement therewith realeasably to interlock the control cage with the stationary control cage adapter. A liner 86, in the form of a ring member of an abrasive resistant metal, is secured to the inner face of the adapter 76 for the protection thereof. The liner is formed with openings 88 in registry with the clamp openings through the adapter releasably to secure the liner to the inner face of the adapter by the same fastening means 82 securing the clamping member to the front face of the adapter.

Means are provided, in accordance with the practice of this invention, for indicating the position of any adjustment of the control cage throughout the full 360° range. For this purpose, there is provided an indicator plate 90 in the form of a flat reversible plate adapted releasably to be secured to the front face of the control cage adapter 76 offset from the clamping means, with the indicator plate having a portion 92 projecting inwardly beyond the inner edge of the adapter plate, with abutments which are adapted to seat within a notch 94 provided in the rim end portion of the control cage. The indicator plate is releasably secured to the front face of the adapter, as by nut and bolt means 96, which extend through aligned openings in the adapter and indicator plate, with the opening 98 in the indicator plate being in the form of an elongate slot having a curvature along a circle the axis of which corresponds to the central axis of the control cage. Thus the indicator is able to follow the rotational adjustment of the control cage to the extent limited by the curvilinear slot 98. Additional circumferentially spaced apart openings 100 are provided in the adapter for movement of the indicator plate from one section to another, which together with the reversibility of the indicator plate, permits rotational movement of the control cage beyond the point limited by the curvilinear slot.

The control cage adapter is marked with indications to identify the position of the control cage and the fastening means serve to maintain the position of the control cage in the adjusted position. The control cage adapter is positioned to locate and support the outer periphery of the control cage and is secured in position of use to a base plate 102 or to the front of the wheel guard housing 104.

While the blades 22 can be dimensioned to have a length corresponding to the distance between the inner and outer peripheries of the wheel plates 10 and 12 so as to be confined between the plates, it is preferred to make use of blades dimensioned to have a length greater than the distance between the inner and outer peripheries of the wheel plates so that the blades will extend free of the plates for a substantial distance beyond their outer peripheries. The blades are dimensioned to have a length to enable the blades to be inserted through the central opening 34 into the crosswise aligned pairs of grooves for endwise displacement radially until stopped when the blades reach their assembled relation in the wheel.

Wheels and blades adapted for internal insertion of the blades through the central opening are described in U.S. Pat. No. 3,683,556 issued Aug. 15, 1972 and entitled "Centrifugal Blasting Wheel". In accordance with the practice of this invention, improvements are provided in the construction of the blades and in the wheels whereby the blades are locked in position of use in the wheel while permitting easy insertion and removal for replacement and repair and whereby the blades are held in position of use in a manner to prevent displacement by gravitational force until all of the blades have been assembled in position of use thereby to enhance the assembly.

As illustrated in the drawings, the blades are a one piece casting of rectangular shape and with a cross section in the form of an I with the lateral side flanges 28 and 30 dimensioned to correspond with the width of the slots 20 to be received in sliding engagement within the slots and with the flat body portions 24 and 26 of the blades spanning the space between the wheel plates 10 and 12. As previously described, the flat body portions 24 and 26 are formed with upper and lower smooth faces of substantially the same shape for enabling either side to represent the throwing surface over which the particulate material is displaced by centrifugal force. The inner end portions 32 of the blades are turned inwardly curvilinearly for minimizing wear on the blades where the blades are engaged by particulate material delivered from the impeller.

As illustrated in the drawings, the blades 22 are dimensioned to have a width from side flange to side flange which is slightly less than the distance between the base portions of the crosswise aligned grooves, so as to provide a spaced relation 105 therebetween whereby particulate material that becomes lodged between the blades and the wheel plates can be received greatly to enhance the ease by which the blades can be displaced into and out of position of use. Locating abutments 106 extend laterally from longitudinally spaced portions of the side walls for a distance slidably to engage the base of the locating grooves thereby firmly to center the blades in the assembled relation between the wheel plates.

The means for stopping radial displacement of the blades upon reaching their assembled position between the wheel plates comprises lugs 108 which extend laterally from the inner end portions of the blades for a distance greater than the distance between the bases of the crosswise aligned grooves so that the lugs will engage the inner periphery of the wheel plates when the blades are in their assembled relation. This provides for centrifugal loading of the blades, whereby centrifugal forces operating on the blades during rotational movement of the wheel in either direction will cause the blades to seek their assembled relation defined by engagement of the lugs 108 with the inner periphery of the wheel plates.

One of the problems encountered when assembly is effected by central insertion of the blades resides in the effect of gravitational forces on the blades whereby inserted blades in the upper segment tend to slip from their grooves during insertion of the remainder of the blades or until the impeller is inserted in position of use to occupy the central opening.

For this purpose, the lugs 108 are dimensioned to extend laterally beyond the base of the crosswise aligned blade receiving grooves but less than the distance between the outer walls of the wheel plates to provide a recessed portion 110 about the lateral edges of the lugs in which the recessed portion defines a cylindrical section adapted to receive a ring member 112 of resilient material which, in the seated relation, resiliently engages the lug portion of the inserted blades to retain the blades in their assembled relation until the impeller has been inserted into position of use within the opening. As illustrated in FIG. 1 of the drawings, the retention ring 112 is trapezoidal in cross section with the inner surface tapered to conform with an opposite taper in the outer edge of the blade lugs whereby the tapered edges provide a cam action which depresses the adjacent ring portion for wedging engagement between the tapered surfaces as the blade is inserted into position of use. The desired retention can also be obtained by use of a ring member of resilient material which deforms on engagement to establish a wedging action.

Since the inner ends of the blades extend beyond the inner periphery of the wheel plates, the cylindrical section of the control cage is dimensioned to have an outer diameter which is less than the diameter of the circular path defined by the inner ends of the assembled blades but greater than the outer diameter of the impeller so as to be received in the annular space defined between the blade ends and the impeller.

It is important for the vanes of the impeller to rotate in time with the blades for feeding the particulate material in timed relation therewith. This is effected in a simple, efficient and positive manner, in accordance with an important concept of this invention, by providing the impeller 38 with an annular flange 114 that extends outwardly from the back wall portion for a distance greater than the radius of the circle formed by the ends of the blades but less than the inner periphery of the central opening in the back wheel plate. The annular flange 114 is formed with circumferentially spaced slots 116 corresponding in number and in space with the number of blades, with the slots dimensioned to have a width slightly greater than the thickness of the lugs 108 on the inner ends of the blades so that, after the blades are in place, the impeller can be inserted axially through the central opening with the inner ends of the blades aligned with the slots for passage therethrough whereby, when in the assembled relation, the inner end portions of the lugs adjacent the back wheel plate are embraced by the annular centering flange 114. Thus the wheel plates operatively engage the impeller to drive the impeller in timed relation with the blades.

In the past, problems have been raised from the accumulation of abrasive particles and dust in the hub seal area, i.e. the area between the rotating hub and the right and left hand hub seals 120 and 122 respectively extending between the guard housing 62 and the hub 58 with a felt pad 124 in between.

Figure 11:
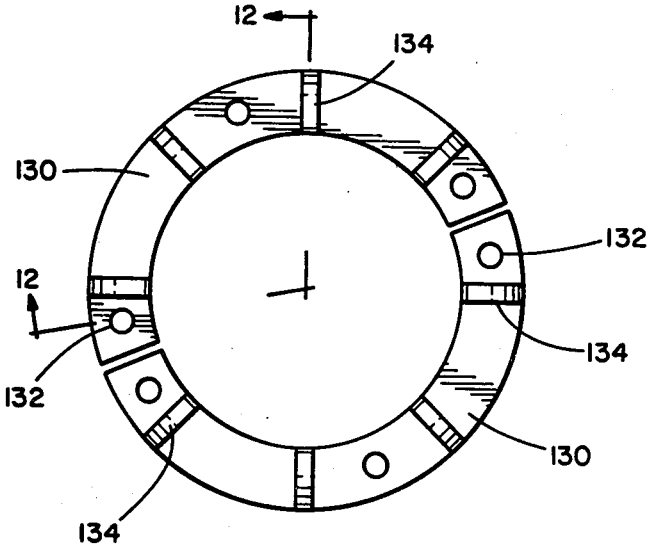
FIG. 11 is an elevational view of the flinger ring.
Figure 12:
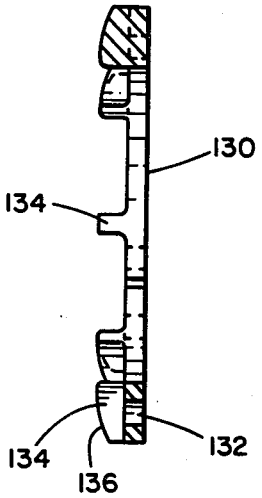
FIG. 12 is an end view partially in section of the flinger ring shown in FIG. 11.
Figure 13:
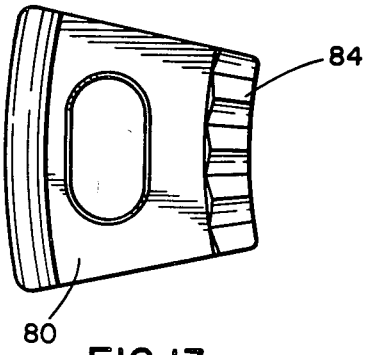
FIG. 13 is a top plan view of the control cage clamp.
Figure 14:
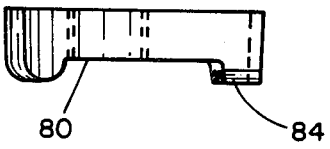
FIG. 14 is a side elevational view of the clamp shown in FIG. 13.

In accordance with a further improvement in the wheel assembly of this invention, means are provided for keeping the hub seal area relatively free of abrasive and dust. Such means operate for displacement by a blowing action created in response to turning movement of the hub and wheel plates attached thereto. The described blowing effect is created by a flinger in the form of a ring member 130 attached to the outer face of the hub flange 58 by way of bolts 131 through holes 132 with circumferentially spaced apart fan blades 134 extending rearwardly from the back face of the flinger ring member. As shown in FIGS. 11 and 12, the fan blades 134 extend rearwardly substantially perpendicularly from the rear face of the ring with an outer curvilinear edge 136 decreasing in dimension from the inner end.

Figure 15:
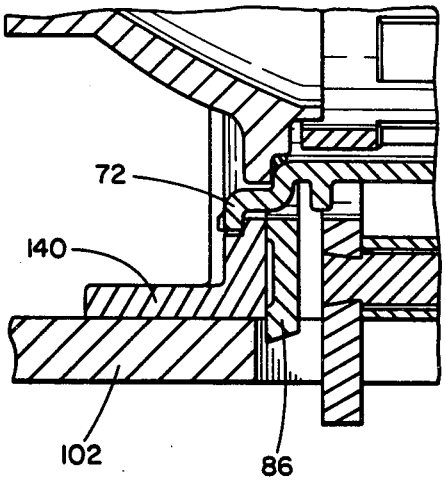
FIG. 15 is a partial view showing the mounting of the adapter onto the base plate when use is made of an indirect drive.
Figure 16:
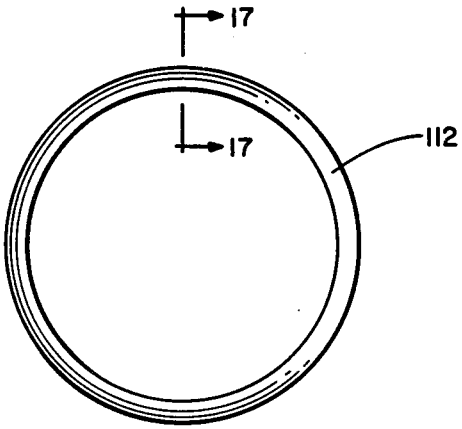
FIG. 16 is a plan view of the retention ring.
Figure 17:
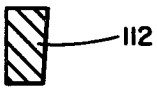
FIG. 17 is a cross sectional view of the retention ring.

The modification shown in FIG. 1 of the drawings is for a wheel that is directly driven and wherein the axis of the wheel is a greater distance from the base plate 102 to accommodate the backing of the electrical motor (not shown). This greater distance permits the use of a full circle control cage adapter 76, mounted on the front wall of the guard housing 104. When use is made of an indirect drive, the axis of the wheel can be a lesser distance from the supporting base plate 102, as shown in FIG. 15. In such event, a full circle adapter 76 is not used and a base mounted adapter 140 is used to secure the adapter 76 to the base plate.

In a further ramification, shown in FIG. 1, the control cage 66 is formed with an annular flange 142 extending outwardly as a ring on the end portion adjacent the feed spout 44 and in radial alignment with the outer portion of the front plate 10 so as to fill the gap 144 between the nominal outside diameter of the cage and the inside diameter of the front wheel plate 10. The ring-flange 142 operates to minimize the induction of air through the gap 144 which when otherwise present tends to pick up stray and rebounding abrasive particles which blast the inner ends of the blades and the adjacent ends of the front wheel plate.

Figure 2:
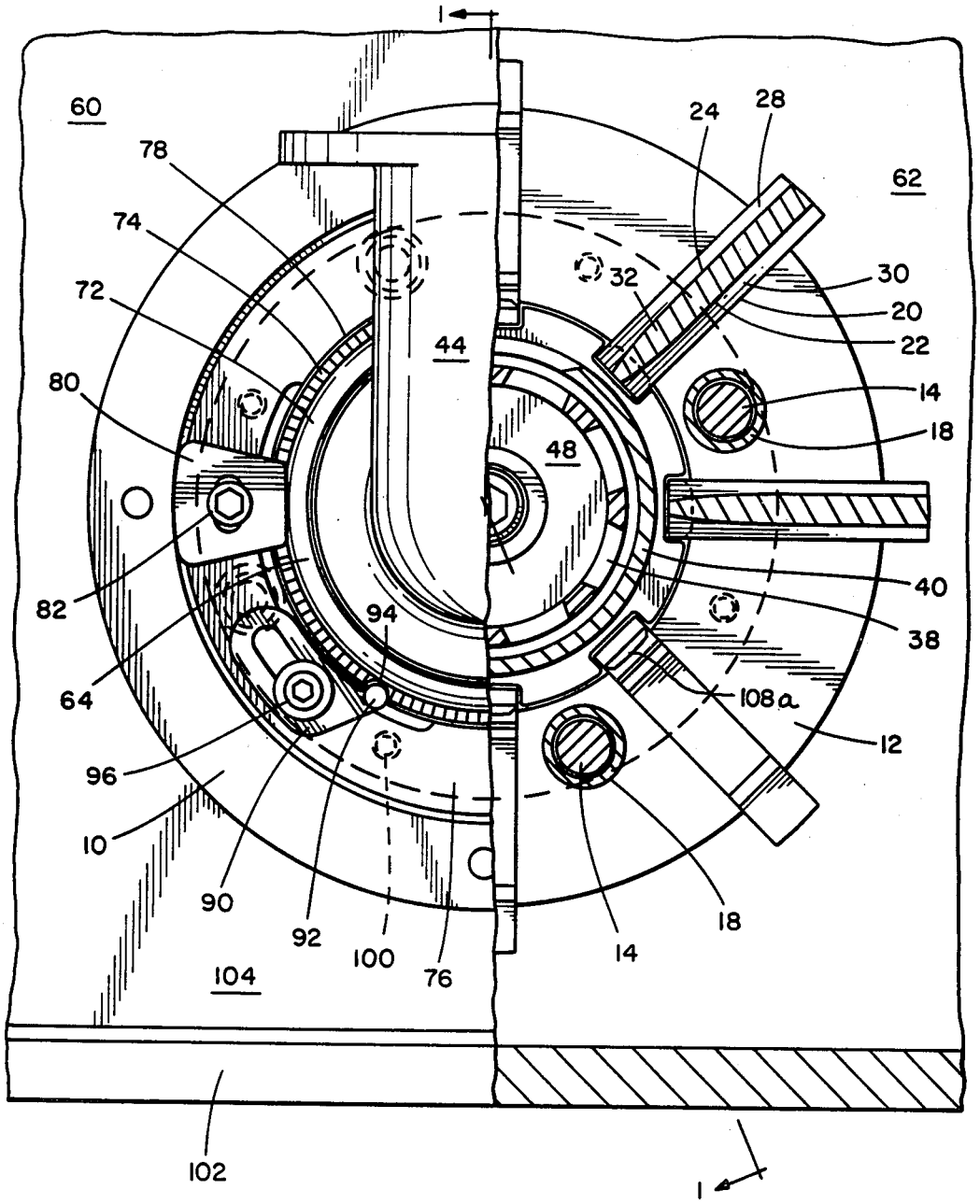
FIG. 2 is a frontal view partially in section of the bladed wheel shown in FIG. 1.
Figure 3:
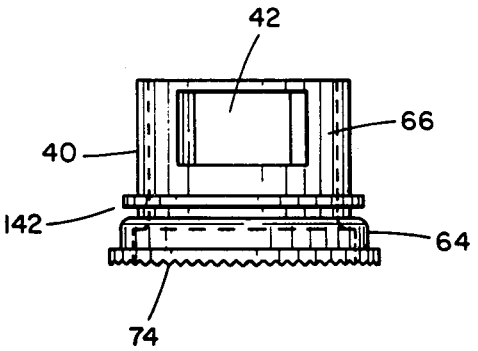
FIG. 3 is an elevational view of the control cage.
Figure 4:
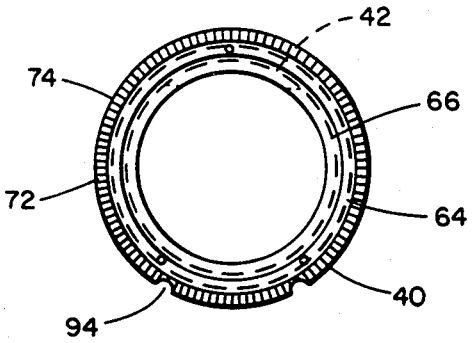
FIG. 4 is an end view of the control cage shown in FIG. 3.
Figure 6:
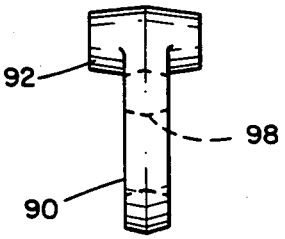
FIG. 6 is an end elevational view of the indicator of FIG. 5.
Figure 5:
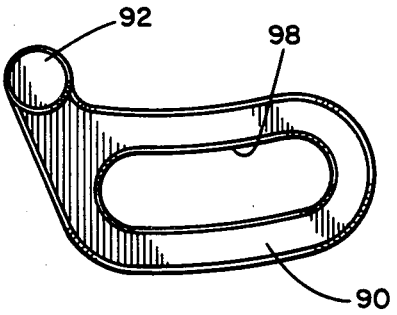
FIG. 5 is a top plan view of the indicator for the control cage.
Figure 7:
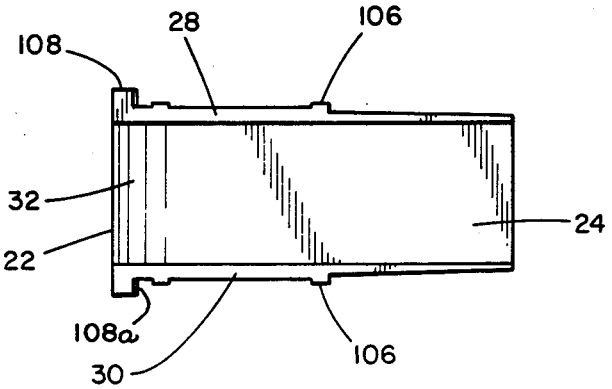
FIG. 7 is a top plan view of a blade member embodying the features of this invention.
Figure 8:
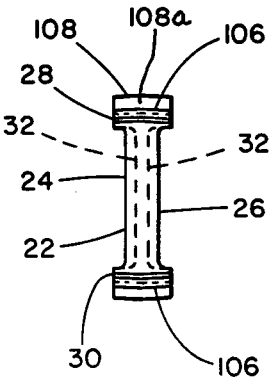
FIG. 8 is an end view of the blade member shown in FIG. 7.
Figure 9:
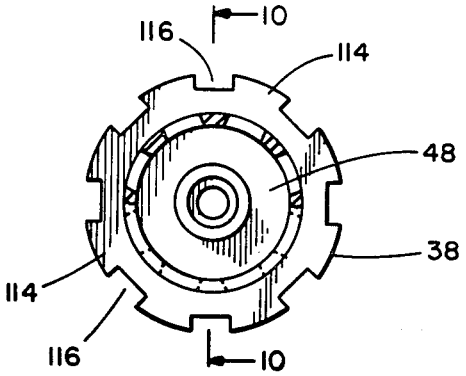
FIG. 9 is a sectional end elevational view of the impeller embodying features of this invention.
Figure 10:
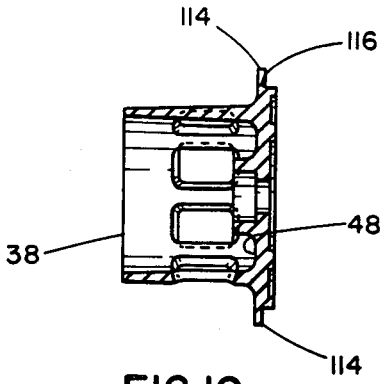
FIG. 10 is a side sectional elevational view of the impeller shown in FIG. 9.

As noted in FIGS. 2, 7 and 8, the lugs 108 are provided with an arcuate abutment surface 108*a* arranged to engage the inner annular surfaces formed by the central openings 34 and 36 in the wheel plates. As can be seen particularly in FIG. 2, the radius of abutment surface 108*a* is less than the radius of the central openings 34, 36. These arcuate abutment surfaces provide improved seating or symmetrical loading of the blades. That is to say, these arcuate surfaces permit the blade to rock or swing as the center of mass of the blade seeks and occupies a radial plane due to the influence of centrifugal forces. These arcuate surfaces will insure that the lines of contact between the lugs and the respective annular surfaces of the wheel plates will be substantially coaxial. Since the center of mass of the blade will be substantially coincident with the geometric center of the blade, these coaxial lines of contact will be contained substantially within the aforesaid radial plane. Thus, these arcuate surfaces minimize development of stress concentrations in the areas of contact between the lugs and the wheel plates. This is a significant feature since the centrifugal forces developed during operation of the wheel are substantial.

Figure 18:
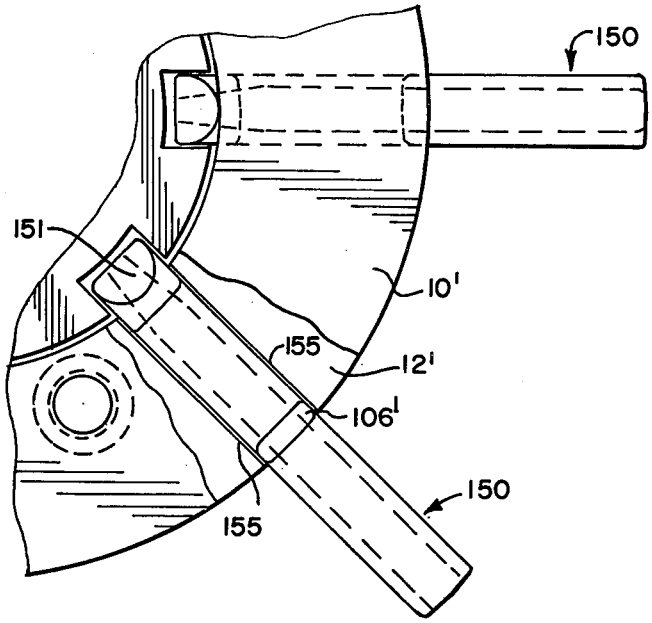
FIG. 18 is a fragmentary side elevation with certain parts broken away to show a modified blade.
Figure 19:
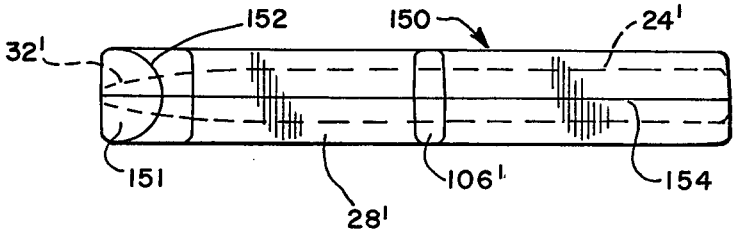
FIG. 19 is a side elevational view of the modified blade.
Figure 20:
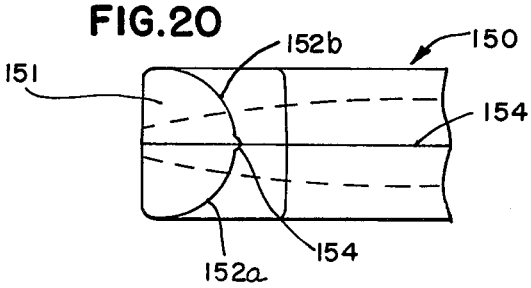
FIG. 20 is fragmentary side elevational view of the modified blade.

A modified blade embodying the principles of the present invention is illustrated in FIGS. 18, 19 and 20. The parts of this modified plate which correspond to the blade shown in FIGS. 1–17 are indicated by the prime form of numeral.

The modified blade 150 has a body generally in the form of a parallelepiped; the blade is provided with a pair of lugs 151 (only one such lug has been illustrated). It is noted that the lug 151 is provided with an arcuate abutment surface 152, the latter being defined by a radius substantially less than the radius of the central openings in the wheel plates as can be seen from FIG. 19. Again, the lines of engagement between the two abutment surfaces 152 and the respective inner annular surfaces of the adjacent wheel plates are substantially coaxial and will be contained substantially in the radial plane which contains the center of mass of the blade. Thus, these arcuate abutment surfaces on the lugs permit the blade to rock or swing slightly for improved symmetrical loading in a manner which does not tend to develop stress concentrations between the lugs and the inner annular surfaces of the wheel plates.

Referring particularly to FIGS. 18 and 19, it is noted that the lug 151 is thicker than the lug 108 as measured along the longitudinal axis of the blade. Consequently, the innermost end of the blade will project a greater distance inwardly of the wheel. To accommodate this greater inward projecting of the blades, the circumferentially spaced slots 116 (FIG. 9) in the annular flange 114 will be made deeper.

The blade 150 is formed by a casting process. This casting process often leaves a rib or parting line flash 154 extending around the exterior surfaces of the blade body 150. At this juncture, it should be pointed out that the blade is symmetrical with respect to a plane containing this parting line flash, which plane also contains the axis of rotation of the wheel (when the blade is operatively mounted in place). Of course, the blade is also symmetrical with respect to a plane perpendicular to the plane just mentioned and which contains the longitudinal center line of the blade.

Not infrequently, the casting process just referred to will result in some small irregularities in the exterior surface of the blade. For example, as seen in FIG. 20, the resulting process may form a lug 151 having arcuate abutment surfaces 152*a* and 152*b* which do not meet to form a smooth formation but rather which form a flash formation 154. Such a formation must be removed by machining or grinding to assure proper contact between the abutment surface 152 and the inner annular surface of the associated wheel plate. Since the abutment of the flash formation 154 on the lug by machining or grinding is greatly facilitated.

As mentioned above, the retention ring 112 is provided to retain the blades in their assembled relation until the impeller has been inserted into its position of use within the wheel. Thus, there is some slight amount of clearance or play between the lateral edge portions 28, 30, 28', 30' of the blades and the slots 20 in the wheel blades; these clearance spaces are designated 155 as seen in FIG. 18. The provision of these clearances in cooperation with the arcuate abutment surfaces permits a slight rocking action of the blades about the arcuate abutment surfaces thereby to permit centrifugal force to cause the blades to seek their proper assembled relationship with respect to the wheel plates. Thus, the arcuate abutment surfaces permit the blades to seat properly thereby contributing to the minimization of stress concentrations.

It will be understood that changes may be made in the details of construction, arrangement and operation, without departing from the spirit of the invention, especially as defined in the following claims.

We claim:

1. For use in a centrifugal blasting wheel of the type including a pair of front and back wheel plates interconnected in spaced parallel relationship with each wheel plate having a central opening defined by an annular surface of constant diameter, wherein said plates are provided with respective cross-wise aligned grooves in their inner faces extending radially in equally circumferentially spaced relationship from the inner annular surfaces of the plates to the outer annular surfaces thereof and opening into each of said annular surfaces, a blade for each pair of said aligned grooves comprising, a body generally in the form of a parallelepiped having an inner and an outer end and side flanges to define a blade of I-shape in transverse cross-section, at least one retaining lug extending laterally from one of the side flanges and being substantially closer to the inner end of said blade body than the outer end thereof, said lug being provided with a curved, non-planer, smooth and uninterrupted abutment surface arranged to be in substantial co-extensive engagement with a portion of the inner annular surface of the adjacent wheel plate when the blade is operatively positioned between a pair of said grooves, thereby to minimize development of stress concentrations between the lug and the adjacent wheel plate, the radius of said abutment surface being coplanar with a radius of the opening defining said inner annular surface, the first-mentioned radius being less in length than the second-mentioned radius, whereby said abutment surface permits rocking of the blade so that radial forces only are transferred from the lug to the adjacent wheel plate.

2. The blade according to claim 1 wherein said body includes a second lug identical to the first-mentioned lug and extending with the latter in opposite hand relation from respective side flanges.

3. A centrifugal blasting wheel blade as claimed in claim 1 in which the portion between the side flanges defines the front and back faces of straight planar sections.

4. A centrifugal blasting wheel blade as claimed in claim 1 in which the portions between the side flanges constitute the front and back faces of the blade, in which the inner end portion of the front face extends curvilinearly in the direction towards the back face to provide for an inner end portion of diminishing thickness.

5. A centrifugal blasting wheel blade as claimed in claim 1 in which the portions between the side flanges define the front and back faces, said front and back faces being of identical configuration with the inner end portions extending curvilinearly in the direction towards each other to provide an inner end portion of diminishing thickness.

6. A centrifugal blasting wheel blade as claimed in claim 1 which includes abutments extending laterally outwardly from longitudinally spaced apart portions of the side flanges.

* * * * *

UNITED STATES PATENT OFFICE

CERTIFICATE OF CORRECTION

Patent No. 4,480,413 Dated November 6, 1984

Inventor(s) Harold F. Schulte et al

It is certified that error appears in the above-identified patent and that said Letters Patent are hereby corrected as shown below:

Column 2, line 50, change "recepts" to --receipt--.

Column 8, line 31, after "abutment" insert --surface is formed at a radius rather than being flat, the removal--.

Signed and Sealed this

*Twenty-eighth* Day of *May 1985*

[SEAL]

*Attest:*

DONALD J. QUIGG

*Attesting Officer* *Acting Commissioner of Patents and Trademarks*